US011939848B1

(12) United States Patent
Al-Arnous et al.

(10) Patent No.: US 11,939,848 B1
(45) Date of Patent: Mar. 26, 2024

(54) NITROGEN LIFT IN WELLS

(71) Applicant: Saudi Arabian Oil Company, Dhahran (SA)

(72) Inventors: Ahmed Bassam Al-Arnous, Udhailiyah (SA); Zakareya Rashed BenSaad, Abqaiq (SA); Nauwar Mohsen Al-Otaibi, Riyadh (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/085,384

(22) Filed: Dec. 20, 2022

(51) Int. Cl.
*E21B 43/12* (2006.01)

(52) U.S. Cl.
CPC ..... *E21B 43/122* (2013.01)

(58) Field of Classification Search
None
See application file for complete search history.

(56) References Cited

U.S. PATENT DOCUMENTS

| | | | | |
|---|---|---|---|---|
| 2,777,399 | A * | 1/1957 | Clark, Jr. | E21B 43/122 417/149 |
| 11,458,419 | B2 | 10/2022 | Almubarak et al. | |
| 2006/0076145 | A1 * | 4/2006 | Lembcke | E21B 43/122 166/372 |
| 2020/0263079 | A1 * | 8/2020 | Bulekbay | C09K 8/588 |

OTHER PUBLICATIONS

Hashmi et al., "Optimization of Nitrogen Lifting Operation in Horizontal Wells of Carbonate Formation," IPTC-22397-MS, presented at the International Petroleum Technology Conference held in Riyadh, Saudi Arabia, Feb. 2022, 19 pages.

Mohamed et al., "Acid Stimulation of Power Water Injectors and Saltwater Disposal Wells in a Carbonate Reservoir in Saudi Arabia: Laboratory Testing and Field Results," presented at the SPE Annual Technical Conference and Exhibition, Houston, Texas, Oct. 1999, 23 pages.

Purusharthy et al., "The First Successful Nitrogen Lifting Job without Stripping Out for a Gas Well in Saudi Arabia," SPE-188063-MS, presented at the SPE Kingdom of Saudi Arabia Annual Technical Symposium and Exhibition held in Dammam, Saudi Arabia, Apr. 2017, 10 pages.

Wrighton et al., "A Novel Technique to Revive Killed Wells Back into Production," presented at the International Petroleum Technology Conference in Dhahran, Saudi Arabia, Jan. 2020, 16 pages.

* cited by examiner

*Primary Examiner* — Andrew Sue-Ako
(74) *Attorney, Agent, or Firm* — Fish & Richardson P.C.

(57) ABSTRACT

Solidified nitrogen is placed at a downhole location within a wellbore formed in a subterranean formation. The solidified nitrogen is encapsulated by an emulsifying agent. The emulsifying agent is configured to dissolve in response to exposure to a downhole fluid. The solidified nitrogen encapsulated by the emulsifying agent is exposed to the downhole fluid at the downhole location within the wellbore, thereby dissolving the emulsifying agent and releasing the solidified nitrogen. The solidified nitrogen is allowed to sublimate into nitrogen gas within the wellbore, thereby reducing hydrostatic column in the wellbore. The downhole fluid is produced from the wellbore to a surface location.

16 Claims, 5 Drawing Sheets

200

300

400

NITROGEN LIFT IN WELLS

TECHNICAL FIELD

This disclosure relates to nitrogen lift in wells.

BACKGROUND

Rocks in a hydrocarbon reservoir store hydrocarbons (for example, petroleum, oil, gas, or combinations of one or more of these), for example, by trapping the hydrocarbons within porous formations in the rocks. These hydrocarbons can be retrieved from the reservoir via one or more wells drilled into the formation. Commercial-scale hydrocarbon production from such source rocks and reservoirs requires significant capital. It is therefore beneficial to optimize cost and design of development to extract as much hydrocarbons as possible from the reservoir within a reasonable amount of time for commercial viability. In some cases, it may be necessary to boost production by providing lift in a well, especially in cases where wellbore pressure has diminished significantly.

SUMMARY

This disclosure describes technologies relating to using solidified nitrogen mixed in an emulsion to produce lift in wells formed in subterranean formations. Certain aspects of the subject matter described can be implemented as a method. Solidified nitrogen is placed at a downhole location within a wellbore formed in a subterranean formation. The solidified nitrogen is encapsulated by an emulsifying agent. The emulsifying agent is configured to dissolve in response to exposure to a downhole fluid. The solidified nitrogen encapsulated by the emulsifying agent is exposed to the downhole fluid at the downhole location within the wellbore, thereby dissolving the emulsifying agent and releasing the solidified nitrogen. The solidified nitrogen is allowed to sublimate into nitrogen gas within the wellbore, thereby reducing hydrostatic column in the wellbore. The downhole fluid is produced from the wellbore to a surface location.

This, and other aspects, can include one or more of the following features. Placing the solidified nitrogen at the downhole location can include placing a housing at the downhole location. The solidified nitrogen encapsulated by the emulsifying agent can be disposed within the housing while the housing is placed at the downhole location. Placing the housing at the downhole location can include lowering the housing into the wellbore to the downhole location via wireline. The housing can be coupled to the wireline. The housing can include a door. Exposing the solidified nitrogen encapsulated by the emulsifying agent to the downhole fluid can include switching the door from a closed position to an open position, thereby releasing the solidified nitrogen encapsulated by the emulsifying agent from the housing. Switching the door from the closed position to the open position can include transmitting an open signal to a motor. The motor can be coupled to the door. Transmitting the open signal to the motor can cause the door to switch from the closed position to the open position. The open signal can be transmitted to the motor once a specified time duration has elapsed after the housing has entered the wellbore. The specified time duration can correspond to a distance traveled by the housing that matches a depth of the downhole location within the wellbore. The method can include detecting that the housing has reached the downhole location within the wellbore. The open signal can be transmitted to the motor to switch the door from the closed position to the open position in response to determining that the housing as reached the downhole location within the wellbore.

Certain aspects of the subject matter described can be implemented as an apparatus. The apparatus includes a housing, solidified nitrogen, and a controller. The housing is configured to be disposed downhole within a wellbore formed in a subterranean formation. The housing is configured to couple to a wireline. The housing includes a door. The door is configured to switch between a closed position and an open position. The solidified nitrogen is disposed within the housing. The solidified nitrogen is encapsulated by an emulsifying agent. The solidified nitrogen encapsulated by the emulsifying agent is disposed within the housing. The emulsifying agent is configured to dissolve in response to exposure to a downhole fluid. The controller is coupled to the housing. The controller is configured to switch the door from the closed position to the open position in response to the housing reaching a specified downhole location within the wellbore, thereby exposing the solidified nitrogen encapsulated by the emulsifying agent to the downhole fluid at the specified downhole location within the wellbore, dissolving the emulsifying agent, and sublimating the solidified nitrogen into nitrogen gas which is released into the wellbore and reduces hydrostatic column in the wellbore.

This, and other aspects, can include one or more of the following features. The housing can be coupled to the wireline. The wireline can extend from a surface location to the specified downhole location within the wellbore. The apparatus can include a motor. The motor can be coupled to the door. The controller can be configured to transmit an open signal to the motor to switch the door from the closed position to the open position. The controller can be configured to transmit the open signal to the motor to switch the door from the closed position to the open position once a specified time duration has elapsed after the housing has entered the wellbore. The specified time duration can correspond to a distance traveled by the housing that matches a depth of the downhole location within the wellbore. The controller can be configured to detect whether the housing has reached the specified downhole location within the wellbore. The controller can be configured to transmit the open signal to the motor to switch the door from the closed position to the open position in response to determining that the housing has reached the specified downhole location within the wellbore.

Certain aspects of the subject matter described can be implemented as a system. The system includes a wellbore, a housing, a wireline, a cartridge, solidified nitrogen, and a charge. The wellbore is formed in a subterranean formation. The wireline extends from a surface location to a downhole location within the wellbore. The housing is coupled to the wireline at the downhole location. The cartridge is disposed within the housing. The solidified nitrogen is encapsulated by an emulsifying agent. The solidified nitrogen encapsulated by the emulsifying agent is disposed within the cartridge. The emulsifying agent is configured to dissolve in response to exposure to a downhole fluid. The charge is disposed within the housing. The charge is connected to the cartridge. The charge is configured to detonate to release the solidified nitrogen encapsulated by the emulsifying agent from the cartridge to the wellbore, thereby exposing the solidified nitrogen encapsulated by the emulsifying agent to the downhole fluid at the downhole location within the wellbore, dissolving the emulsifying agent, and sublimating the solidified nitrogen into nitrogen gas which is released into the wellbore and reduces hydrostatic column in the wellbore.

This, and other aspects, can include one or more of the following features. The system can include a controller. The controller can be coupled to the housing. The controller can be communicatively coupled to the charge. The controller can be configured to transmit a detonation signal to the charge to detonate the charge and release the solidified nitrogen encapsulated by the emulsifying agent from the cartridge to the wellbore. The controller can be configured to transmit the detonation signal to the charge to detonate the charge and release the solidified nitrogen encapsulated by the emulsifying agent from the cartridge to the wellbore once a specified time duration has elapsed after the housing has entered the wellbore. The specified time duration can correspond to a distance traveled by the housing that matches a depth of the downhole location within the wellbore. The controller can be configured to detect whether the housing has reached the specified downhole location within the wellbore. The controller can be configured to transmit the detonation signal to the charge to detonate the charge and release the solidified nitrogen encapsulated by the emulsifying agent from the cartridge to the wellbore in response to determining that the housing has reached the specified downhole location within the wellbore.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes nitrogen lift in wells. The nitrogen is in solid form and covered in an emulsified material as it travels within a storing chamber conveyed via slickline or e-line to a desired depth in a subterranean formation. A pre-set timer can open the chamber to release the emulsified, solid nitrogen. Upon opening of the chamber, the nitrogen sublimates and releases into the subterranean formation in the form of nitrogen gas, thereby reducing hydrostatic column in the well and reviving the well. Multiple chambers including the emulsified, solid nitrogen can be deployed based on the amount of nitrogen required to facilitate production from the well.

The subject matter described in this disclosure can be implemented in particular implementations, so as to realize one or more of the following advantages. Production from a well can be boosted and/or revived without requiring the use of rotating equipment, such as a pump or compressor. In contrast, production can be boosted and/or revived by non-rotating equipment, which can incur less capital, operating, and maintenance costs in comparison to rotating equipment. The apparatuses, systems, and methods described here use solidified nitrogen which is denser than liquid nitrogen and gaseous nitrogen and therefore more volume efficient in comparison to conventional nitrogen lifting techniques that utilize liquid and/or gaseous nitrogen. The apparatuses, systems, and methods described here can be implemented to boost and/or revive production from a well more efficiently, more quickly, and at reduced cost in comparison to conventional nitrogen lifting techniques that deploy liquid and/or gaseous nitrogen from the surface.

Figure 1:
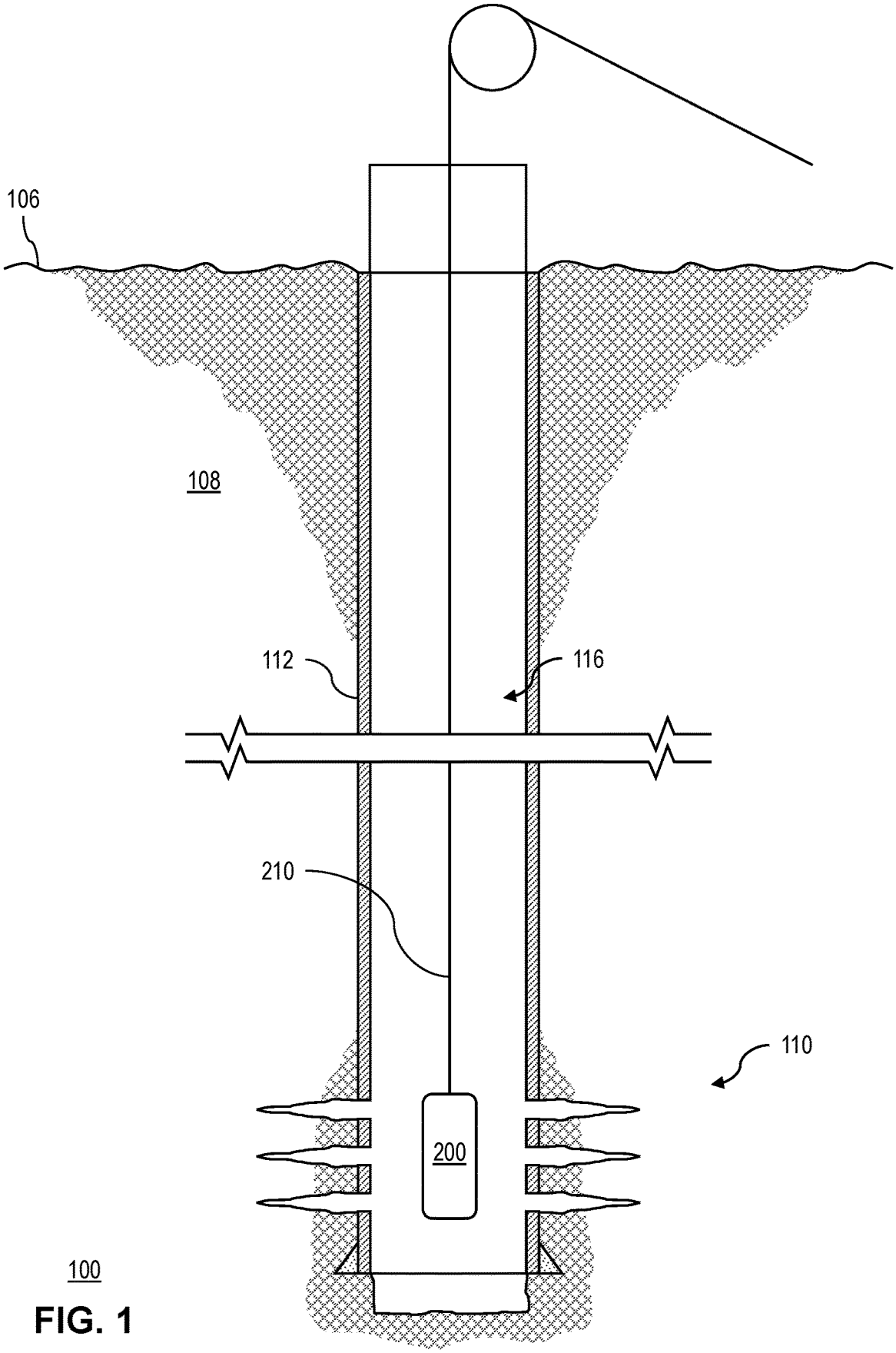
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In FIG. 1, the casing 112 is perforated in the subterranean zone of interest 110 to allow fluid communication between the subterranean zone of interest 110 and the bore 116 of the casing 112. In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached to the wellhead. The Christmas tree includes valves used to regulate flow into or out of the well 100. The well 100 can include an apparatus 200 residing in the wellbore, for example, at a depth that is nearer to subterranean zone 110 than the surface 106. The apparatus 200 can revive and/or improve production of fluid from the well 100. For example, the apparatus 200 can implement nitrogen lift within the well 100 to improve and/or revive production from the well 100. The construction of the components of the apparatus 200 are configured to withstand the impacts, scraping, and other physical challenges the apparatus 200 will encounter while being passed hundreds of feet/meters or even multiple miles/kilometers into and out of the well 100. For example, the apparatus 200 can be disposed in the well 100 at a depth of up to 20,000 feet (6,096 meters). Beyond just a rugged exterior, this encompasses having certain portions of any electronics being ruggedized to be shock resistant and remain fluid tight during such physical challenges and during operation. Additionally, the apparatus 200 is configured to withstand and operate for extended periods of time (for example, multiple minutes, hours, days, weeks, months, or years) at the pressures and temperatures experienced in the well 100, which temperatures can exceed 400 degrees Fahrenheit (° F.)/205 degrees Celsius (° C.) and pressures over 2,000 pounds per square inch gauge (psig), and while submerged in the well fluids (gas, water, or oil as examples). Finally, the apparatus 200 can be configured to interface with one or more of the common deployment systems, such as jointed tubing (that is, lengths of tubing joined end-to-end), a sucker rod, coiled tubing (that is, not-jointed tubing, but rather a continuous, unbroken and flexible tubing formed as a single piece of material), wireline (such as a slickline), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector). In some implementations, as shown in FIG. 1, the apparatus 200 is coupled to (and deployed downhole by) a wireline 210 (which can be, for example, a slickline or an e-line) that extends from the surface 106 to a specified downhole location near the subterranean zone 110.

Figure 2:
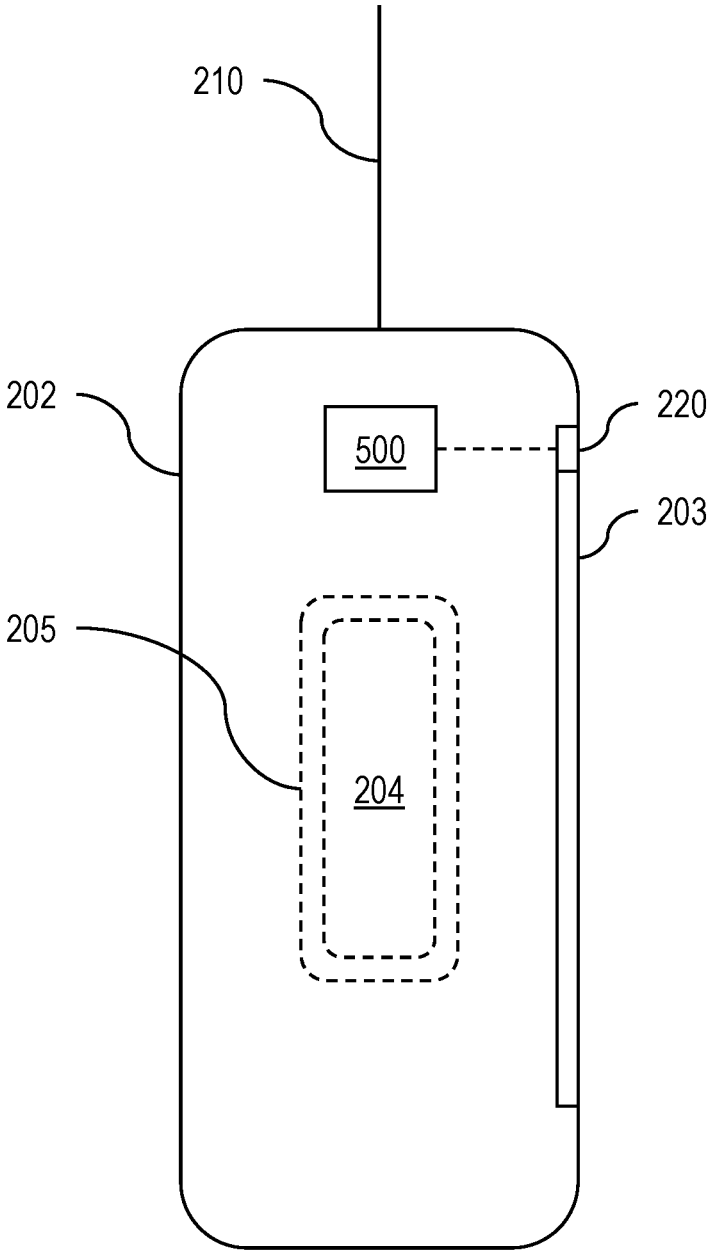
FIG. 2 is a schematic diagram of an example apparatus that can be implemented in the well of FIG. 1 to improve production from the well.

FIG. 2 is a schematic diagram of an example apparatus 200 that can be implemented in the well 100, for example, to improve and/or revive production from the well 100. The apparatus 200 includes a housing 202, solidified nitrogen 204, and a controller 500. The housing 202 is configured to be disposed downhole within a wellbore formed in a subterranean formation (such as the wellbore of the well 100). The housing 202 includes a door 203. The door 203 is configured to switch between a closed position and an open position. The solidified nitrogen 204 is disposed within the housing 202. The solidified nitrogen 204 is encapsulated by an emulsifying agent 205.

The emulsifying agent 205 can include, for example, an emulsified-acid additive (such as U108 by Schlumberger), a polymer-based emulsifier (such as phenyl cyclohexane polyethylene glycol), a concentrated tall oil derivative (such as FACTANT™ Emulsifier by Halliburton), or any combination of these. The emulsifying agent 205 is configured to dissolve in response to exposure to a downhole fluid (such as a hydrocarbon). That is, the emulsifying agent 205 is soluble in the downhole fluid. In some implementations, the solidified nitrogen 204 is included in an emulsion including the emulsifying agent 205. In some implementations, the solidified nitrogen 204 is included in an acid emulsified with a hydrocarbon. The acid in the emulsion can include any acid (such as hydrochloric acid or acetic acid) that can be used in oil and gas well acidizing, which is a well stimulation treatment process. For example, the solidified nitrogen 204 is included in hydrochloric acid emulsified with diesel or acetic acid emulsified with diesel. In some implementations, the emulsifying agent 205 includes a polymer that is soluble in hydrocarbon(s). For example, the emulsifying agent 205 includes a polymer that is soluble in crude oil and/or natural gas. For example, the emulsifying agent 205 includes a polymer that is soluble in heavy-grade crude oil (American Petroleum Institute (API) gravity in a range of from about 26° to about 29°), medium-grade crude oil (API gravity in a range of from about 29° to about) 32°, light-grade crude oil (API gravity in a range of from about 32° to about 34°), extra light-grade crude oil (API gravity in a range of from about 36° to about 41°), super light-grade crude oil (API gravity in a range of from about 49° to about 52°), or any combination of these.

The controller 500 is coupled to the housing 202. The controller 500 is configured to switch the door 203 from the closed position to the open position in response to the housing 202 reaching a specified downhole location within the wellbore. Opening the door 203 exposes the solidified nitrogen 204 encapsulated by the emulsifying agent 205 to the downhole fluid at the specified downhole location within the wellbore. Exposure to the downhole fluid at the specified downhole location within the wellbore dissolves the emulsifying agent 205. Dissolution of the emulsifying agent 205 exposes the solidified nitrogen 204, which exposes the solidified nitrogen 204 to downhole conditions (for example, downhole pressure and/or downhole temperature), thereby allowing the solidified nitrogen 204 to change state (for example, sublimate from solid to gas) based on the downhole conditions. The nitrogen can release into the wellbore as nitrogen gas, which reduces the hydrostatic column in the wellbore, thereby reviving and/or improving flow (production) of downhole fluid to the surface 106. In some implementations, the housing 202 includes multiple chambers, and each chamber houses its own solidified nitrogen 204 encapsulated by the emulsifying agent 205.

In some implementations, the apparatus 200 includes a motor 220 that is coupled to the door 203 and communicatively coupled to the controller 500. The motor 220 can be configured to switch the door 203 between the closed position and the open position. For example, the controller 500 can transmit an open signal to the motor 220 to switch the door 203 from the closed position to the open position.

For example, the controller 500 can transmit a close signal to the motor 220 to switch the door 203 from the open position to the closed position. In some implementations, the controller 500 is configured to transmit the open signal to the motor 220 once a specified time duration has elapsed after the housing 202 has entered the wellbore (for example, from the surface 106), wherein the specified time duration corresponds to a distance traveled by the housing 202 that matches a depth of the specified downhole location within the wellbore. For example, the housing 202 can be deployed downhole (for example, via the wireline 210) at a constant rate, and the controller 500 can track the time elapsed since the housing 202 entered the wellbore and multiply the time elapsed by the rate at which the housing 202 travels downhole to determine a distance traveled (for example, depth) by the housing 202. In some implementations, the controller 500 is configured to detect whether the housing 202 has reached the specified downhole location within the wellbore. For example, the controller 500 can detect a depth of the housing 202 in relation to the surface 106 within the wellbore to determine whether the housing 202 has reached the specified downhole location within the wellbore. In such implementations, the controller 500 can be configured to transmit the open signal to the motor 220 to switch the door 203 from the closed position to the open position in response to determining that the housing 202 has reached the specified downhole location within the wellbore.

In some implementations, the controller 500 is configured to retain the door 203 in the closed position until the housing 202 has reached the specified downhole location within the wellbore. In response to the housing 202 reaching the specified downhole location within the wellbore, the controller 500 can release the door 203 to switch to the open position. For example, the door 203 can be biased toward the open position by a spring, and the controller 500 can magnetize the door 203 to keep the door 203 in the closed position against the spring bias while the housing 202 travels downhole into the wellbore toward the specified downhole location. Once the housing 202 has reached the specified downhole location within the wellbore, the controller 500 can de-magnetize the door 203, and the spring bias can swing the door to the open position.

Figure 3:
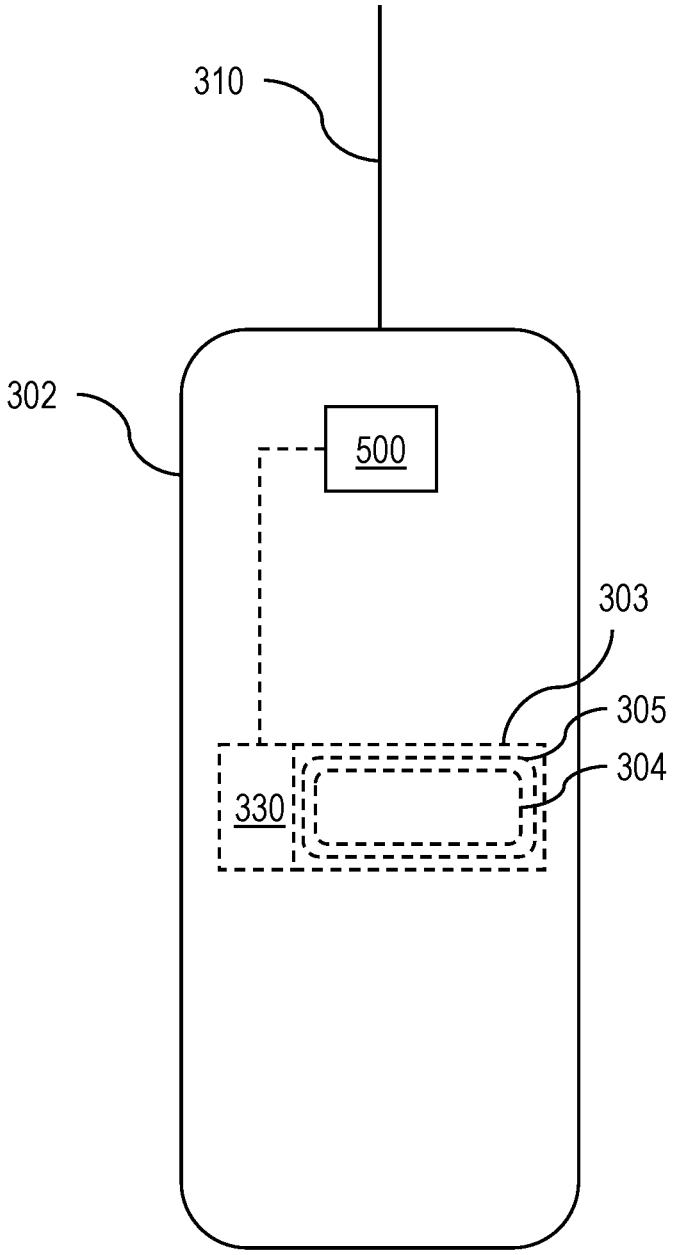
FIG. 3 is a schematic diagram of an example apparatus that can be implemented in the well of FIG. 1 to improve production from the well.

FIG. 3 is a schematic diagram of an example apparatus 300 that can be implemented in the well 100, for example, to improve and/or revive production from the well 100. For example, apparatus 300 can replace the apparatus 200 shown in FIG. 1. The apparatus 300 can be substantially similar to the apparatus 200 shown in FIG. 2. The apparatus 300 includes a housing 302, a cartridge 303, solidified nitrogen 304, and a charge 330. The housing 302 is configured to be disposed downhole within a wellbore formed in a subterranean formation (such as the wellbore of the well 100). The solidified nitrogen 304 is encapsulated by an emulsifying agent 305. The solidified nitrogen 304 encapsulated by the emulsifying agent 305 is disposed within the cartridge 303. The cartridge 303 is disposed within the housing 302. The emulsifying agent 305 is configured to dissolve in response to exposure to a downhole fluid (such as a hydrocarbon). That is, the emulsifying agent 305 is soluble in the downhole fluid. The charge 330 is disposed within the housing 302. The charge 330 is connected to the cartridge 303. The charge 330 is configured to detonate to release the solidified nitrogen 304 encapsulated by the emulsifying agent 305 from the cartridge 303 to the wellbore, thereby exposing the solidified nitrogen 304 encapsulated by the emulsifying agent 305 to the downhole fluid at the specified downhole location within the wellbore. The charge 330 can, for example, perform similarly as charges in a perforation gun for perforating tubulars installed in wellbores. Exposure to the downhole fluid at the specified downhole location within the wellbore dissolves the emulsifying agent 305. Dissolution of the emulsifying agent 305 exposes the solidified nitrogen 304, which exposes the solidified nitrogen 304 to downhole conditions (for example, downhole pressure and/or downhole temperature), thereby allowing the solidified nitrogen 304 to change state (for example, sublimate from solid to gas) based on the downhole conditions. The nitrogen can release into the wellbore as nitrogen gas, which reduces the hydrostatic column in the wellbore, thereby reviving and/or improving flow (production) of downhole fluid to the surface 106. In some implementations, the housing 302 includes multiple cartridges 303, and each cartridge 303 houses its own solidified nitrogen 304 encapsulated by the emulsifying agent 305. In some implementations, a single charge 330 detonates to release the solidified nitrogen 304 encapsulated by the emulsifying agent 305 from all of the cartridges 303. In some implementations, each cartridge 303 is equipped with its own designated charge 330 for release of the solidified nitrogen 304 encapsulated by the emulsifying agent 305 into the wellbore.

In some implementations, the apparatus 300 includes the controller 500. The controller 500 can be coupled to the housing 302. The controller 500 can be communicatively coupled to the charge 330. The controller 500 can be configured to transmit a detonation signal to the charge 330 to detonate the charge 330 and release the solidified nitrogen 304 encapsulated by the emulsifying agent 305 from the cartridge 303 to the wellbore. In some implementations, the controller 500 is configured to transmit the detonation signal to the charge 330 once a specified time duration has elapsed after the housing 302 has entered the wellbore (for example, from the surface 106), wherein the specified time duration corresponds to a distance traveled by the housing 302 that matches a depth of the specified downhole location within the wellbore. For example, the housing 302 can be deployed downhole (for example, via the wireline 310) at a constant rate, and the controller 500 can track the time elapsed since the housing 302 entered the wellbore and multiply the time elapsed by the rate at which the housing 302 travels downhole to determine a distance traveled (for example, depth) by the housing 302. In some implementations, the controller 500 is configured to detect whether the housing 302 has reached the specified downhole location within the wellbore. For example, the controller 500 can detect a depth of the housing 302 in relation to the surface 106 within the wellbore to determine whether the housing 302 has reached the specified downhole location within the wellbore. In such implementations, the controller 500 can be configured to transmit the detonation signal to the charge 330 to detonate the charge 330 in response to determining that the housing 302 has reached the specified downhole location within the wellbore.

Figure 4:
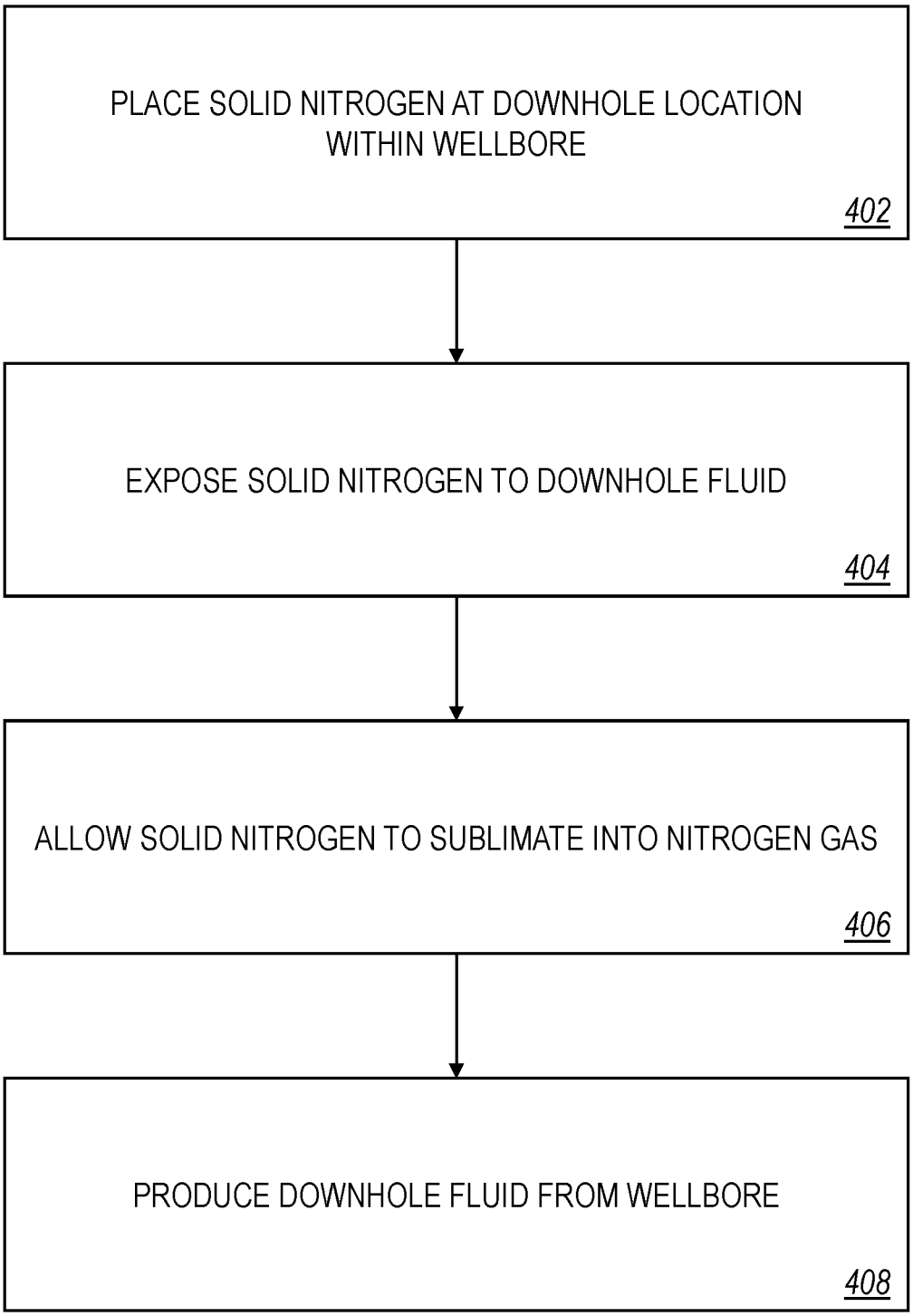
FIG. 4 is a flow chart of an example method for improving production from a well.

FIG. 4 is a flow chart of an example method 400 for improving production from a well, such as the well 100. Any of the apparatuses 200 or 300 can, for example, implement the method 400. For simplicity and clarity, the description of the method 400 in this paragraph is described in relation to the apparatus 200 (although the apparatus 300 can optionally be used instead). At block 402, solidified nitrogen (such as the solidified nitrogen 204) is placed at a downhole location within a wellbore formed in a subterranean formation (such as the wellbore of the well 100). As described previously, the solidified nitrogen 204 is encapsulated by an emulsifying agent (such as the emulsifying agent 205) which is configured to dissolve in response to exposure to a downhole fluid. In some implementations, placing the solidified nitrogen 204 at the downhole location at block 402 includes placing a housing (such as the housing 202) at the downhole location, and the solidified nitrogen 204 encapsulated by the emulsifying agent 205 is disposed within the housing 202 while the housing 202 is placed at the downhole location. In some implementations, the housing 202 is coupled to a wireline (such as the wireline 210), and placing the housing 202 at the downhole location includes lowering the housing 202 into the wellbore to the downhole location via the wireline 210. At block 404, the solidified nitrogen 204 encapsulated by the emulsifying agent 205 is exposed to the downhole fluid at the downhole location within the wellbore, thereby dissolving the emulsifying agent 205 and releasing the solidified nitrogen 204. In some implementations, the housing 202 includes a door (such as the door 203), and exposing the solidified nitrogen 204 encapsulated by the emulsifying agent 205 at block 404 includes switching the door 203 from a closed position to an open position, thereby releasing the solidified nitrogen 204 encapsulated by the emulsifying agent 205 from the housing 202. In some implementations, switching the door from the closed position to the open position includes transmitting an open signal to a motor (such as the motor 220) that is coupled to the door 203 to switch the door 203 from the closed position to the open position. The open signal can, for example, be transmitted by the controller 500. In some implementations, the open signal is transmitted by the controller 500 to the motor 220 once a specified time duration has elapsed after the housing 202 has entered the wellbore, where the specified time duration corresponds to a distance traveled by the housing 202 that matches a depth of the downhole location within the wellbore. In some implementations, the method 400 includes detecting whether the housing 202 has reached the downhole location within the wellbore, and the open signal is transmitted by the controller 500 to the motor 220 to switch the door 203 from the closed position to the open position in response to determining that the housing 202 has reached the downhole location within the wellbore. At block 406, the solidified nitrogen 204 is allowed to sublimate into nitrogen gas within the wellbore, thereby reducing hydrostatic column in the wellbore. At block 408, the downhole fluid is produced from the wellbore to a surface location (such as the surface 106).

Figure 5:
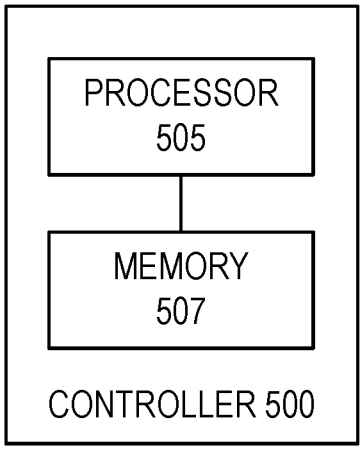
FIG. 5 is a block diagram of an example computer system.

FIG. 5 is a block diagram of an example controller 500 used to provide computational functionalities associated with described algorithms, methods, functions, processes, flows, and procedures, as described in this specification, according to an implementation. The illustrated controller 500 is intended to encompass any computing device such as a server, desktop computer, laptop/notebook computer, one or more processors within these devices, or any other processing device, including physical or virtual instances (or both) of the computing device. Additionally, the controller 500 can include a computer that includes an input device, such as a keypad, keyboard, touch screen, or other device that can accept user information, and an output device that conveys information associated with the operation of the controller 500, including digital data, visual, audio information, or a combination of information.

The controller 500 includes a processor 505. The processor 505 may be a microprocessor, a multi-core processor, a multithreaded processor, an ultra-low-voltage processor, an embedded processor, or a virtual processor. In some embodiments, the processor 505 may be part of a system-on-a-chip (SoC) in which the processor 505 and the other components of the controller 500 are formed into a single integrated electronics package. In some implementations, the processor 505 may include processors from Intel® Corporation of Santa Clara, California, from Advanced Micro Devices, Inc. (AMD) of Sunnyvale, California, or from ARM Holdings, LTD., Of Cambridge, England. Any number of other processors from other suppliers may also be used. Although illustrated as a single processor 505 in FIG. 5, two or more processors may be used according to particular needs, desires, or particular implementations of the controller 500. Generally, the processor 505 executes instructions and manipulates data to perform the operations of the controller 500 and any algorithms, methods, functions, processes, flows, and procedures as described in this specification. The processor 505 may communicate with other components of the controller 500 over a bus. The bus may include any number of technologies, such as industry standard architecture (ISA), extended ISA (EISA), peripheral component interconnect (PCI), peripheral component interconnect extended (PCIx), PCI express (PCIe), or any number of other technologies. The bus may be a proprietary bus, for example, used in an SoC based system. Other bus technologies may be used, in addition to, or instead of, the technologies above.

The controller 500 also includes a memory 507 that can hold data for the controller 500 or other components (or a combination of both) that can be connected to the network. Although illustrated as a single memory 507 in FIG. 5, two or more memories 507 (of the same or combination of types) can be used according to particular needs, desires, or particular implementations of the controller 500 and the described functionality. While memory 507 is illustrated as an integral component of the controller 500, memory 507 can be external to the controller 500. The memory 507 can be a transitory or non-transitory storage medium. In some implementations, such as in PLCs and other process control units, the memory 507 is integrated with a database used for long-term storage of programs and data. The memory 507 can include any number of volatile and nonvolatile memory devices, such as volatile random-access memory (RAM), static random-access memory (SRAM), flash memory, and the like. In smaller devices, such as PLCs, the memory 507 may include registers associated with the processor 505 itself.

The memory 507 stores computer-readable instructions executable by the processor 505 that, when executed, cause the processor 505 to perform operations, such as transmitting the open signal to the door 203 or motor 220 or transmitting the detonation signal to the charge 330. The controller 500 can also include a power supply. The power supply can include a rechargeable or non-rechargeable battery that can be configured to be either user- or non-user-replaceable. The power supply can be hard-wired. There may be any number of controllers 500 associated with, or external to, a computer system containing controller 500, each controller 500 communicating over the network. Further, the term "client," "user," "operator," and other appropriate terminology may be used interchangeably, as appropriate, without departing from this specification. Moreover, this specification contemplates that many users may use one controller 500, or that one user may use multiple controllers 500.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

placing solidified nitrogen at a downhole location within a wellbore formed in a subterranean formation, wherein the solidified nitrogen is encapsulated by an emulsifying agent configured to dissolve in response to exposure to a downhole fluid;

exposing the solidified nitrogen encapsulated by the emulsifying agent to the downhole fluid at the downhole location within the wellbore, thereby dissolving the emulsifying agent and releasing the solidified nitrogen;

allowing the solidified nitrogen to sublimate into nitrogen gas within the wellbore, thereby reducing hydrostatic column in the wellbore; and producing the downhole fluid from the wellbore to a surface location.

2. The method of claim 1, wherein placing the solidified nitrogen at the downhole location comprises placing a housing at the downhole location, wherein the solidified nitrogen encapsulated by the emulsifying agent is disposed within the housing while the housing is placed at the downhole location.

3. The method of claim 2, wherein placing the housing at the downhole location comprises lowering the housing into the wellbore to the downhole location via wireline, wherein the housing is coupled to the wireline.

4. The method of claim 3, wherein the housing comprises a door, and exposing the solidified nitrogen encapsulated by the emulsifying agent to the downhole fluid comprises switching the door from a closed position to an open position, thereby releasing the solidified nitrogen encapsulated by the emulsifying agent from the housing.

5. The method of claim 4, wherein switching the door from the closed position to the open position comprises transmitting an open signal to a motor coupled to the door to switch the door from the closed position to the open position.

6. The method of claim 5, wherein the open signal is transmitted to the motor once a specified time duration has elapsed after the housing has entered the wellbore, wherein the specified time duration corresponds to a distance traveled by the housing that matches a depth of the downhole location within the wellbore.

7. The method of claim 5, comprising detecting that the housing has reached the downhole location within the wellbore, and the open signal is transmitted to the motor to switch the door from the closed position to the open position in response to determining that the housing as reached the downhole location within the wellbore.

8. An apparatus comprising:

a housing configured to be disposed downhole within a wellbore formed in a subterranean formation, the housing configured to couple to a wireline, the housing comprising a door configured to switch between a closed position and an open position;

solidified nitrogen disposed within the housing, the solidified nitrogen encapsulated by an emulsifying agent configured to dissolve in response to exposure to a downhole fluid; and a controller coupled to the housing, the controller configured to switch the door from the closed position to the open position in response to the housing reaching a specified downhole location within the wellbore, thereby exposing the solidified nitrogen encapsulated by the emulsifying agent to the downhole fluid at the specified downhole location within the wellbore, dissolving the emulsifying agent, and sublimating the solidified nitrogen into nitrogen gas which is released into the wellbore and reduces hydrostatic column in the wellbore.

9. The apparatus of claim 8, wherein the housing is coupled to the wireline, the wireline extending from a surface location to the specified downhole location within the wellbore.

10. The apparatus of claim 9, comprising a motor coupled to the door, wherein the controller is configured to transmit an open signal to the motor to switch the door from the closed position to the open position.

11. The apparatus of claim 10, wherein the controller is configured to transmit the open signal to the motor to switch the door from the closed position to the open position once a specified time duration has elapsed after the housing has entered the wellbore, wherein the specified time duration corresponds to a distance traveled by the housing that matches a depth of the downhole location within the wellbore.

12. The apparatus of claim 10, wherein the controller is configured to detect whether the housing has reached the specified downhole location within the wellbore, and the controller is configured to transmit the open signal to the motor to switch the door from the closed position to the open position in response to determining that the housing has reached the specified downhole location within the wellbore.

13. A system comprising:

a wellbore formed in a subterranean formation;

a housing;

a wireline extending from a surface location to a downhole location within the wellbore, the housing coupled to the wireline at the downhole location;

a cartridge disposed within the housing;

solidified nitrogen encapsulated by an emulsifying agent, the solidified nitrogen encapsulated by the emulsifying agent disposed within the cartridge, the emulsifying agent configured to dissolve in response to exposure to a downhole fluid; and a charge disposed within the housing and connected to the cartridge, the charge configured to detonate to release the solidified nitrogen encapsulated by the emulsifying agent from the cartridge to the wellbore, thereby exposing the solidified nitrogen encapsulated by the emulsifying agent to the downhole fluid at the downhole location within the wellbore, dissolving the emulsifying agent, and sublimating the solidified nitrogen into nitrogen gas which is released into the wellbore and reduces hydrostatic column in the wellbore.

14. The system of claim 13, comprising a controller coupled to the housing and communicatively coupled to the charge, wherein the controller is configured to transmit a detonation signal to the charge to detonate the charge and release the solidified nitrogen encapsulated by the emulsifying agent from the cartridge to the wellbore.

15. The system of claim 14, wherein the controller is configured to transmit the detonation signal to the charge to detonate the charge and release the solidified nitrogen encapsulated by the emulsifying agent from the cartridge to the wellbore once a specified time duration has elapsed after the housing has entered the wellbore, wherein the specified time duration corresponds to a distance traveled by the housing that matches a depth of the downhole location within the wellbore.

16. The system of claim 14, wherein the controller is configured to detect whether the housing has reached the downhole location within the wellbore, and the controller is configured to transmit the detonation signal to the charge to detonate the charge and release the solidified nitrogen encapsulated by the emulsifying agent from the cartridge to the wellbore in response to determining that the housing has reached the downhole location within the wellbore.

* * * * *